United States Patent [19]

Kilmer

[11] Patent Number: 4,620,574

[45] Date of Patent: Nov. 4, 1986

[54] HAND SQUEEZE TERMINAL WIRE CONNECTING TOOL

[75] Inventor: Paul R. Kilmer, Leroy, Mich.

[73] Assignee: Cooper Industries, Inc., Houston, Tex.

[21] Appl. No.: 692,112

[22] Filed: Jan. 17, 1985

[51] Int. Cl.[4] ..... B21F 3/00

[52] U.S. Cl. ..... 140/124; 74/395; 403/DIG. 8; 403/161

[58] Field of Search ..... 140/117, 124; 81/57.29; 74/392, 395, 396, 397; 72/409; 403/DIG. 7, DIG. 8, 150, 161, 408

[56] References Cited

U.S. PATENT DOCUMENTS

| | | | |
|---|---|---|---|
| 1,815,450 | 7/1931 | Schmal | 74/396 |
| 2,953,950 | 8/1956 | Briney, Jr. et al. | 408/173 |
| 3,006,443 | 10/1961 | Siler | 403/408 |
| 3,132,549 | 5/1964 | Lee | 81/57.29 |

FOREIGN PATENT DOCUMENTS

| | | | |
|---|---|---|---|
| 737149 | 6/1966 | Canada | 140/124 |
| 957564 | 5/1964 | United Kingdom | 403/150 |

*Primary Examiner*—Francis S. Husar
*Assistant Examiner*—Robert Showalter
*Attorney, Agent, or Firm*—Finnegan, Henderson, Farabow, Garrett & Dunner

[57] ABSTRACT

A manually-operated terminal wire connecting tool having an eccentric cam pivot for adjusting the degree of contact between gear rack assembly and rotating drive assembly. The eccentric cam allows for selective adjustment of contact between gear rack and rotatable drive assembly. Machining tolerances in manufacture of the tools are thereby increased and, in addition, consumers can compensate for gear wear over the life of the tool.

12 Claims, 12 Drawing Figures

HAND SQUEEZE TERMINAL WIRE CONNECTING TOOL

BACKGROUND OF THE INVENTION

1. Field of the Invention

This invention relates generally to the field of manually powered tools and, more particularly, concerns manually-operated terminal wire connecting tools actuated by squeezing a movable lever to produce a rotating motion for twisting or untwisting wires about terminal posts.

2. Description of Prior Art

Terminal wire connecting tools can be used to give a solderless contact by tightly twining wire around a given surface. They can be used to establish electrical contact, to mechanically link objects together or for a number of other purposes. Generally, such tools are electrically, pneumatically or manually powered and use mechanically interconnected gears to turn a terminal wire connecting bit.

The present invention is primarily concerned with manually-operated terminal wire connecting tools, such as those used by telephone repairmen, electronic technicians, service men and others who are sometimes without the luxury of electrical power.

Often in manually-operated tools, a lever or handle is pivotably mounted on the frame of the tool, and a gear rack is located on one end of the lever, usually opposite the pivotal mounting. When squeezed, the lever moves "toward" the rear of the tool in a manner similar to a trigger being squeezed on a gun. The movement of the lever causes movement of the gear rack which drives a spur gear meshed with the gear rack resulting in driving the rotating mechanism of the tool. The speed and number of rotations delivered can usually be controlled by controlling the rate and the amount of force applied by hand.

It has been found that currently available manually-operated terminal wire connecting tools are prone to wear, especially in the areas of contact between the gear rack and the spur gear and in the area of the frame where the lever is pivotably mounted.

Normal friction and stresses occasioned during use are the major factors contributing to wear, though in part wear can be attributed to the uneven squeezing pressures exerted by the action of a human hand. Squeezing movements are not as uniform or one directional as the movement produced by an electrical motor in power tools, and lateral pressures shifting sporadically from side to side contribute to wear. When the opposing teeth of the spur gear and gear rack are shifted against each other, the opposing gear teeth can become worn or rounded, increasing the likelihood of slippage or disengagement. As time progresses, the tools can develop an annoying "play," that decreases their efficiency and makes them more difficult to use.

A separate problem associated with manually-powered terminal wire connecting tools is the close machining tolerances required during their manufacture, especially tolerances associated with mounting the lever on the frame, and those required to ensure an accurate gear tooth profile. Close tolerances increase manufacturing costs.

Hence, a manually-operated terminal wire connecting tool which can compensate for wear, eliminate "play" as it develops, and which does not require close machining tolerances during manufacture is very desirable, and a substantial savings in cost could be enjoyed by both manufacturer and consumer.

SUMMARY OF THE INVENTION

Accordingly, it is an objective of the present invention to provide a manually-operated terminal wire connecting tool that is less prone to breakdown or to development of "play" because of wear.

Another objective of the invention is to provide a manually-operated terminal wire connecting tool that does not require the close machining tolerances of some terminal wire connecting tools presently marketed.

Another objective is to provide a terminal wire connecting tool that is both long-lasting and economical.

Additional objectives and advantages of the invention will be set forth in the description that follows and in part will be obvious from the description, or may be learned by practice of the invention.

The objectives and advantages of the invention may be realized and obtained by means of instrumentalities and combinations particularly pointed out in the appended claims. To achieve these objectives and in accordance with the purpose of the invention, the present invention provides a manually-operated terminal wire connecting apparatus comprising a frame, a rotatable drive assembly and a hand-actuated lever pivotably mounted on the frame by means of a cam, means for adjusting the position of the cam, the lever having a gear rack formed on one end remote from the cam, and drive means for mechanically interconnecting the gear rack and the rotatable drive assembly of the tool. The lever is mounted such that the relative position of the gear rack and drive means can be selectively adjusted by adjusting the cam. The relative proximity of the gear rack and the rotatable drive assembly can be selectively adjusted by adjusting the cam, which can be an eccentric cam, with a conventional tool such as an allen key or screwdriver.

As used in this application, the term eccentric cam includes cylindrical structures having a pivotal axis parallel to the geometric axis of rotation of the cylinder, but off-center, so that rotating the cylinder around the pivotal axis produces an up and down motion.

The cam is fixedly mounted in opposing apertures in the frame and retained by a friction fit with the walls defining the apertures. The lever pivots on the cam, and in a preferred embodiment, a circular aperture formed near one end of the lever accommodates the cam. When the cam needs adjusting, a tool is applied near its pivotal axis and sufficient rotational pressure is applied to overcome the frictional engagement of the cam with the frame. As the cam is selectively adjusted, it causes the lever (and thus the gear rack) to advance toward or retreat from the spur gear, much in the fashion of the shaft attached offcenter of the drive wheel of an old locomotive. Preferably, the maximum displacement of the lever, controlled by adjusting the eccentric cam, is less than the difference between the addendum and dedendum lengths of the teeth on the gear rack so that the opposing teeth of the rack and spur gear are continuously engaged.

In another embodiment, the amount of displacement of the lever can be greater than the difference between the dededum and addendum lengths of the teeth on the gear rack so that the opposing teeth of the gear rack and spur gear can be completely disengaged by selectively adjusting the eccentric cam.

The eccentric cam reduces the criticality of alignment between the gear rack and spur gear during assembly because the gears can at first be loosely fitted and aligned, and then adjusted by adjusting the cam. Hence, costs are reduced.

As the teeth of the spur gear or gear rack become worn and develop "play," the cam can be rotatably adjusted so that close contact between the gears is renewed and a desirable fit achieved.

The accompanying drawings, which are incorporated in and constitute a part of this specification, illustrate a preferred embodiment of the invention and, together with the description, serve to explain the principles of the invention. The invention, however, is not limited to the embodiments depicted in the drawings.

BRIEF DESCRIPTION OF THE DRAWINGS

In the drawings, like reference numbers designate like or corresponding parts throughout the several views.

DETAILED DESCRIPTION OF THE PREFERRED EMBODIMENT

Reference will now be made in detail to the presently preferred embodiment of the invention, an example of which is illustrated in the accompanying drawings.

Figure 2:
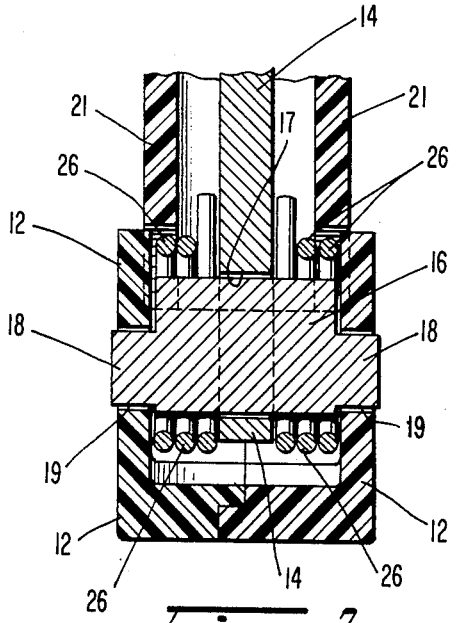
FIG. 2 is a section view of the cam of FIG. 1 taken along line 2—2.
Figure 6:
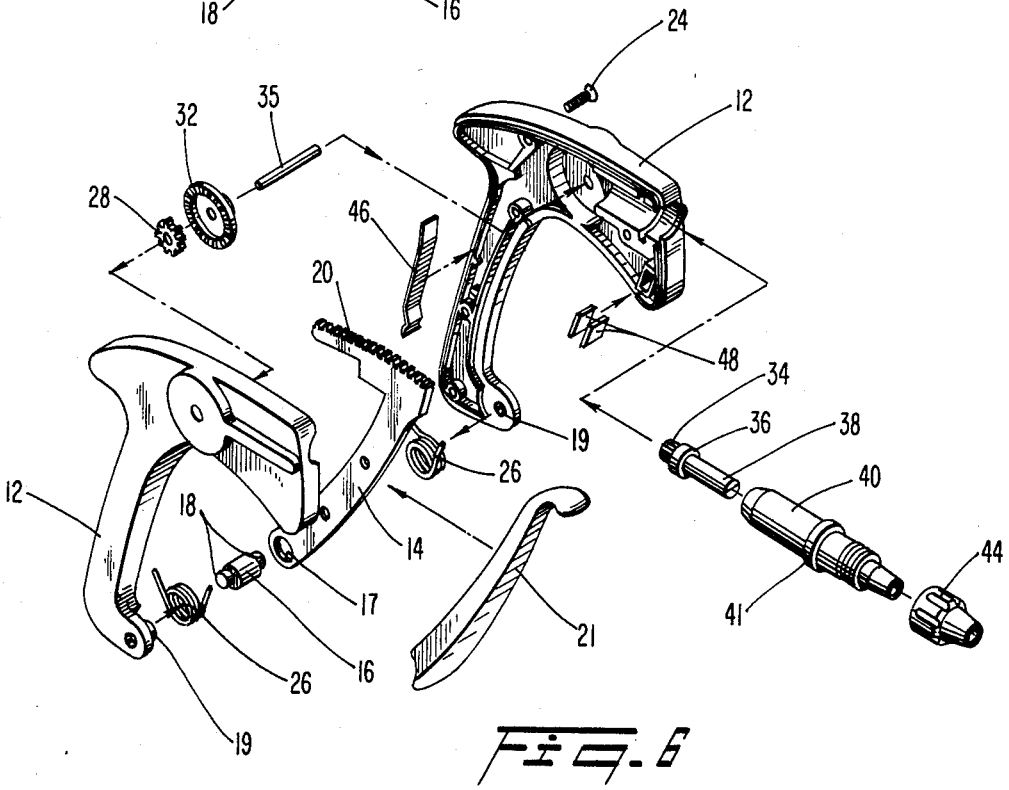
FIG. 6 is an exploded view of the embodiment of FIG. 1.

A preferred embodiment of the improved terminal wire connecting tool is represented generally by numeral 10. As can be seen from the drawings, the manually-operated wire wrapping tool 10 includes a frame 12, and a hand-actuated lever 14 movably mounted on the frame 12 by means of a cam 16. The lever 14 has a circular aperture 17 near one end through which the eccentric cam 16 is fitted. The diameter of the aperture 17 is slightly larger than the cam diameter thereby permitting the lever 14 to rotate easily relative to the cam 16. As can be seen in FIGS. 2 and 6, the cam 16 has pins 18 extending from each end which are fitted for frictional engagement in aperture 19 in the frame 12.

The diameters of the apertures 19 can be as much as a couple of thousandths of an inch less than the outer diameter of the pins 18. Hence, there is sufficient pressure and friction to hold the pins 18 and cam 16 in place when not being adjusted. Alternative methods of securing the cam 16 are within the scope of the present invention. One alternative method is to employ threaded lock nuts on either side of a threaded pin, so that the cam 16 can be tightened in place by screwing the threaded nuts against the frame 12.

Figure 3:
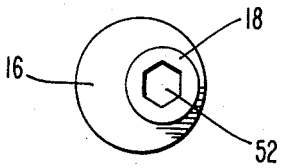
FIG. 3 is a side view of the cam of FIG. 2.

As shown in FIG. 3, the pins 18 are mounted off-center of the actual geometric axis of the cylindrical cam 16. At least one of the pins 18 has a socket 52 adapted to fit a tool (not shown). In the depicted embodiment the socket is hexagonal and adapted to fit a conventional allen key.

The hand actuated lever 14, having a gear rack 20 formed at one end, is adapted for comfortable squeezing by having a hand guard 21 mounted substantially along the length of the lever 14 by any suitable mounting means such as pins 22. The frame 12 preferably is formed of two, complimentary, near-symetrical halves (see FIG. 6) which, when assembled, are held together by screws 24. Two spring members 26 are mounted about the cam 16, one on either side of the lever 14, such that force from the springs biases the lever 14 in a direction outwardly from the frame 12. In the preferred embodiment, the spring members 26 are coil springs and are positioned about the cam to exert a force against the frame 12 and the hand guard 21 that is, in turn, transmitted to the lever 14.

When squeezed, the lever 14 pivots on the eccentric cam 16 towards the rear of the frame 12, and the spring members 26 are thereby further tensioned. The squeezing movement provides power for the terminal wire connecting tool 10 in the manner described below.

The gear rack 20 is formed or mounted near the end of the lever 14 opposite the cam 16 and includes a plurality of teeth (some not shown) which intermesh with the teeth of a spur gear 28 which is part of a rotatable drive assembly 30.

Figure 1:
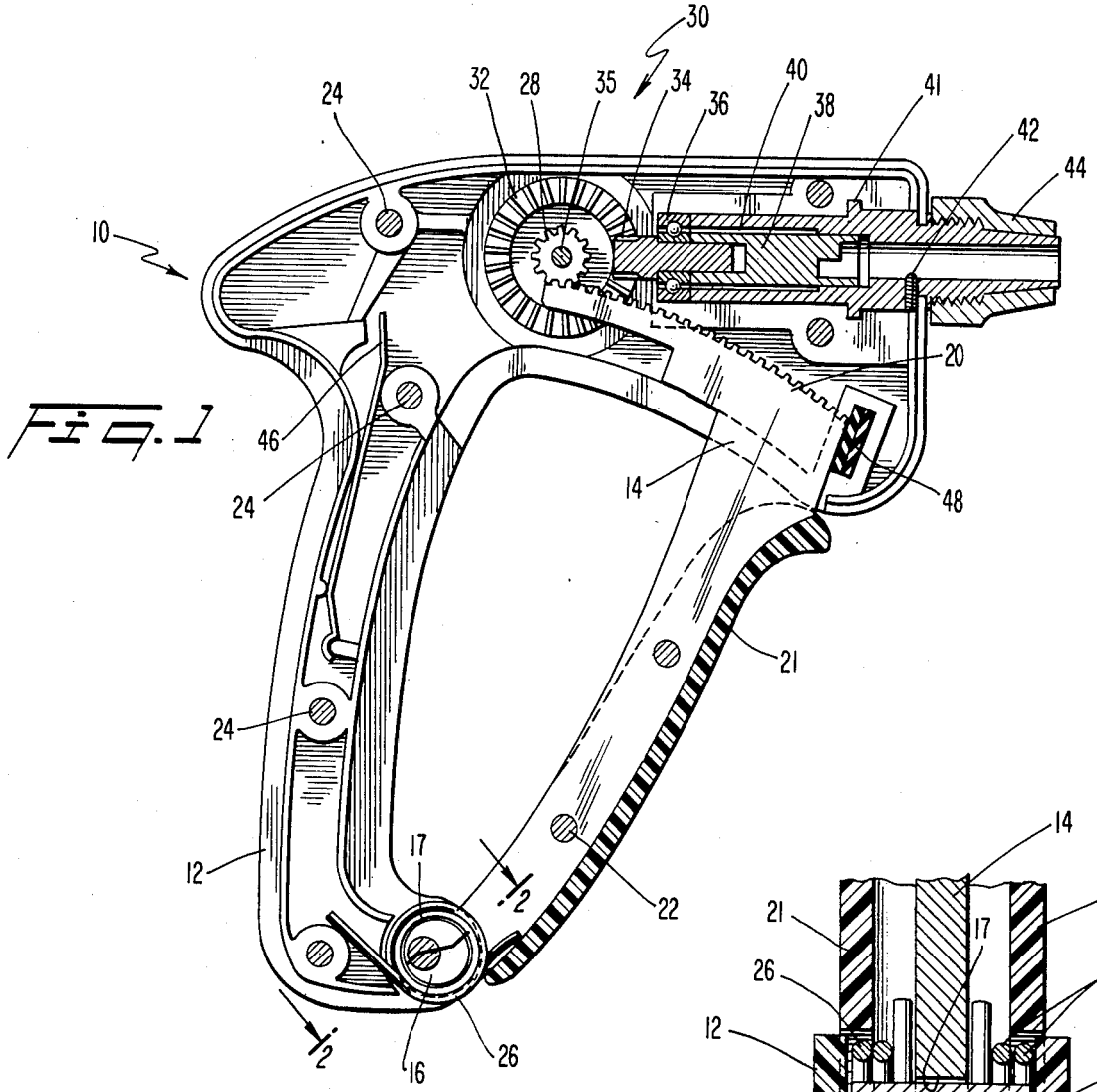
FIG. 1 is a partially sectioned side elevational view of the preferred embodiment of the terminal wire connecting tool of this invention.

The specific construction of the rotatable drive assembly 30 is not in itself considered a critical part of the present invention, since any conventional drive assembly may be used. Generally, these assemblies comprise a spur gear, a driven gear and various translational gears that are designed to impart of rotational motion to an output shaft or bit. In the presently preferred embodiment, the rotatable drive assembly comprises a spur gear 28 integrally formed and coaxial with a driven gear 32, a pinion gear 34 a bearing 36, a drive shaft 38, and a drive housing 40. The gear rack 20 drives the spur gear 28 and the driven gear 32 in a clockwise direction (FIG. 1) thereby driving the pinion gear which drivingly engages the drive shaft 38, such as by means of a key. The drive shaft 38 is rotatably mounted in the drive housing 40 which is held in place in the frame 12 by any suitable means such as a retaining shoulder 41. An adjustable collet nut 44 is adapted to engage a threaded end of the drive housing 40 to secure a terminal wire connecting bit (not shown) when inserted into the drive housing 40 to engage the drive shaft 38.

In a preferred embodiment, the spur gear 28 and driven gear 32 are formed from as an integral member and are rotatably mounted in the frame by means of a shaft 35. The shaft 35 is mounted in a first recess (not shown) in the frame 12, and the spur gear 28 and driven gear 32 are rotatably mounted on the shaft 35. In a further embodiment, the complimentary half of the frame 12 includes a second recess, opposing and axially aligned with the first recess. By mounting the spur gear 28, driven gear 32 and shaft 35 in the second recess their orientation and rotation is reversed (compare FIG. 1 and FIG. 6). In other words, the gear rack 20 now causes the spur gear 28 and driven gear 32 to rotate counterclockwise which in turn, causes the rotary direction of the drive shaft 38, when the lever 14 is squeezed, to be reversed. In this manner, the tool 10 can be adjusted for clockwise or counterclockwise rotation suitable for twining or untwining simply by disassembling the halves of the frame 12, by turning the spur and driven gears 28 and 32 over and mounting them on the shaft 35 and reassembling the frame 12. If during disassembly the position of the cam 16 is accidentally changed, or if the spur gear 28 and gear rack 20 are not sufficiently intermeshed, the cam 16 can be adjusted by rotating the cam 16 to obtain the desired degree of contact between the gear rack 20 and spur gear 28.

In operation, when the lever 14 is squeezed toward the rear of the frame 12, the gear rack 20 drives the spur gear 28 and driven gear 32 and the rotatable drive assembly 30. A backstop 46, comprised of a tensioned bar or leaf spring positioned within the frame 12, is contacted by the gear rack 20 as it is squeezed toward frame 12. The backstop 46 aids in avoiding impact of the gear rack 20 against the frame 12. The backstop 46 exerts force against the gear rack 20 and is mounted to permit travel a short distance with increasing resistance against the gear rack 20, thus encouraging the gear rack 20 to slow down as it approaches the frame 12. When pressure on the lever 14 is released, the spring members 26 cause the lever 14 to return to its normal rest position. The lever 14 comes to rest when the gear rack 20 abuts against a gear rack stop 48 mounted in the frame 12. Preferably, a shock absorbing piece of resilient material, such as rubber, can be included on one side of the stop 48 to help absorb impact or to act as a spacer.

As wear occurs in the area of contact between the spur gear 28 and gear rack 20, the cam 16 can be selectively adjusted to compensate for the wear. This can be accomplished by inserting a conventional allen wrench or similar tool into socket or slot in cam 16 and applying a rotating force to the cam with sufficient force to overcome the frictional fit between the cam 16 and the frame 12.

Figure 4:
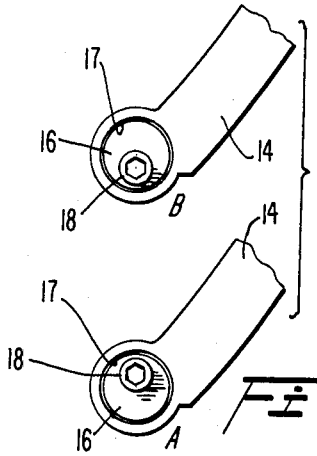
FIG. 4 shows the cam of FIG. 2 and a portion of the lever in uppermost and lowermost adjustment positions.
Figure 5:
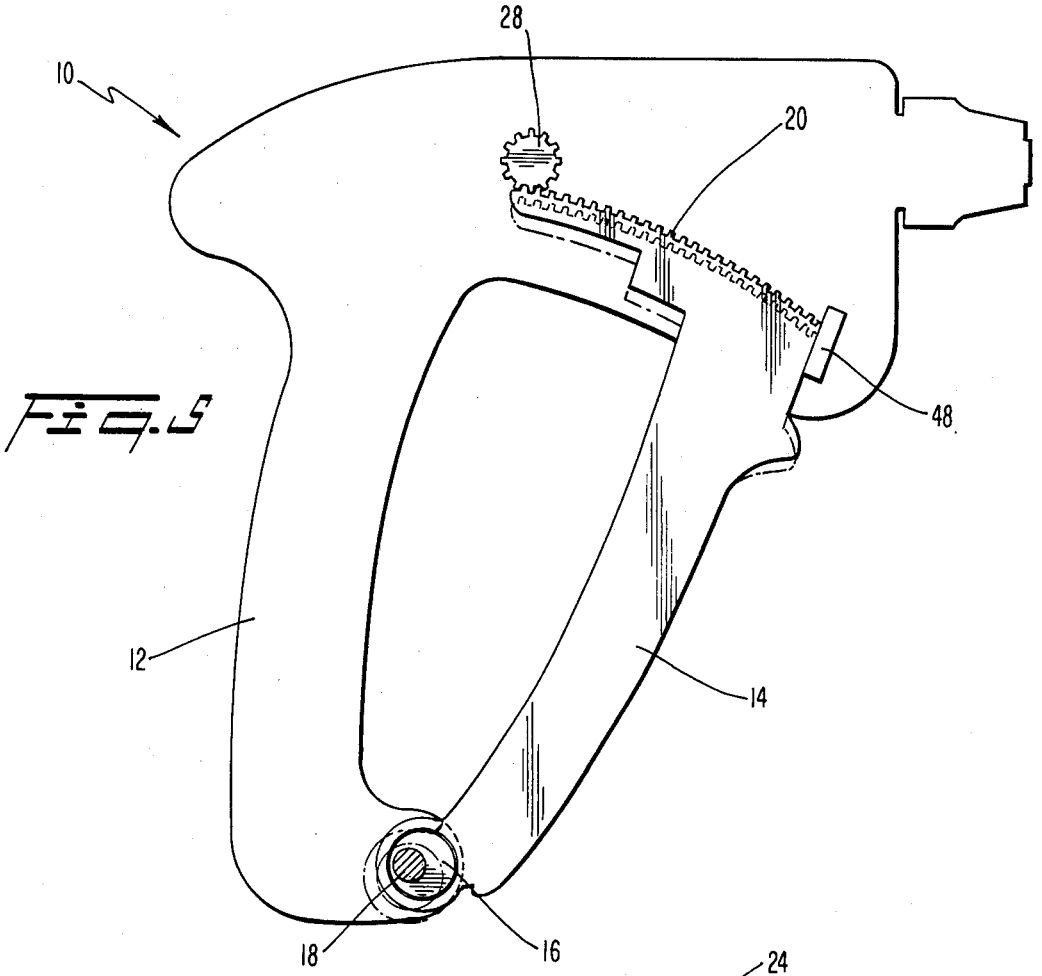
FIG. 5 is a schematic diagram illustrating two different adjustment positions of the cam, gear rack and spur gear; the lower positions being illustrated with phantom lines and the upper position being illustrated with solid lines.

In FIGS. 4 and 5, two adjustment positions of the cam 16 are depicted. As can be understood from the drawings in conjunction with the foregoing discussion, when not being adjusted the pin 18 is normally held in place in aperture 19 in the frame 12 by a force fit. When adjustment of the gear rack 20 relative to the spur gear 28 is desired, the pin 18 and cam 16 rotated. Because of the eccentric location of the pin 18 relative to the geometric axis of the cam 16, the cam can be moved from a lower position (FIG. 4A) to a higher position (FIG. 4B) causing the lever 14 and gear rack 20 also to move closer toward spur gear 28 (FIG. 5). The cam 16 is rotated until the lever 14 and the gear rack 20 are moved toward the spur gear 28, and the desired fit is achieved. For the most part, the fit is a matter of personal preference, though too tight a fit will make the lever difficult to squeeze, will actually increase wear and may cause the lever to stick in the squeezed position.

Figure 7A:
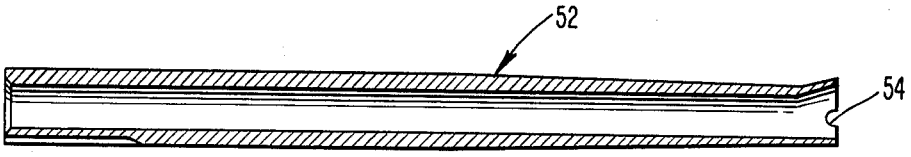
FIG. 7A is a sectional view of a stationary sleeve for use with a preferred embodiment of the tool.
Figure 7B:
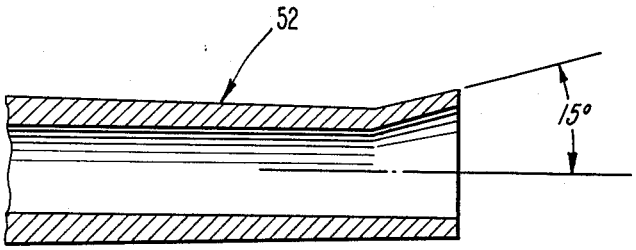
FIG. 7B is a detailed sectional view showing the stationary sleeve used with a preferred embodiment of the present invention.
Figure 7C:
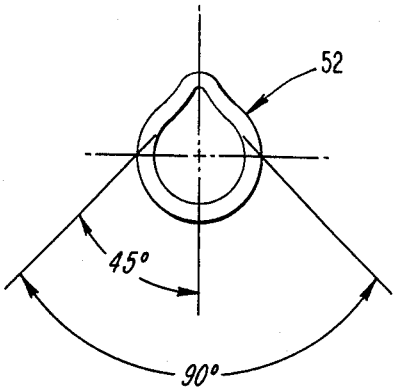
FIG. 7C is a detailed end view of the stationary sleeve.
Figure 8A:
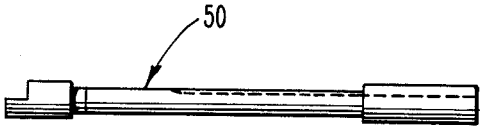
FIG. 8A is a side view of a terminal wire connecting bit.
Figure 8B:
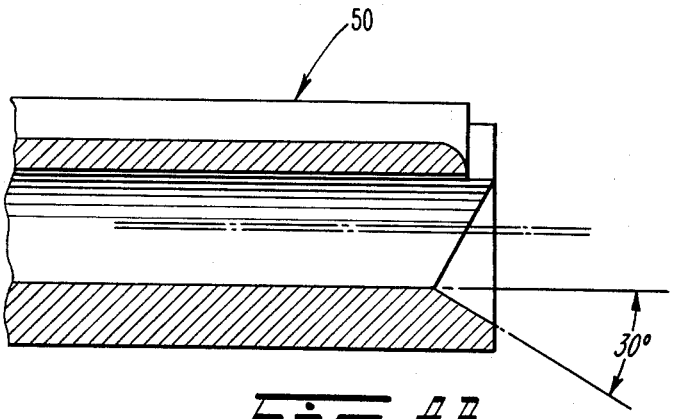
FIG. 8B is a detailed sectional view of the end of a terminal wire connecting bit.
Figure 8C:
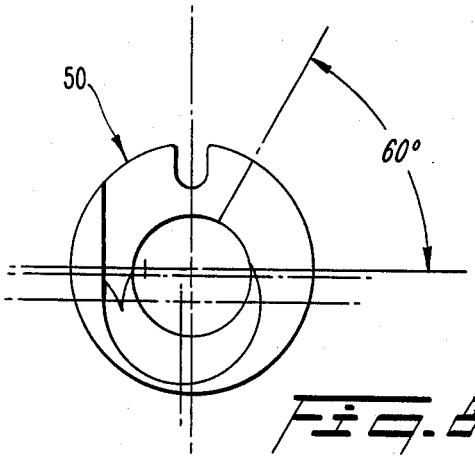
FIG. 8C is a detailed end view of the terminal end of a terminal wire connecting bit.

In operation, the terminal wire connecting bit 50 (shown in FIGS. 8A, B and C) is inserted into the drive housing 40 and drivingly engages the drive shaft 38. Preferably, a stationary sleeve 52 (shown in FIGS. 7A, B and C) having a slot 54 at one end is slipped over the shaft of the bit and inserted into the drive housing 40. The slot 54 straddles a pin 42 protruding within the drive housing 40 to position the stationary sleeve 52 radially. The stationary sleeve 52 is used to support the terminal wire connecting bit, both as a guide and a bearing. The collet nut 44 is tightened to secure the stationary sleeve. the end of the drive housing 40 is slit and threaded so that as the collet nut is tightened the ends are slightly crimped and the opposing sides of the slit are forced together.

In the preferred embodiment, the frame is made of a lightweight but durable plastic such as polycarbonate plastic, and the cam 16 is formed of a lightweight and durable sintered metal.

Various modifications of the present invention could be made or would be obvious to one of ordinary skill in the art. Such modifications are intended to be within the scope of the present invention and the appended claims.

What is claimed is:

1. A manually actuated terminal wire connecting apparatus, comprising:

a frame;

a rotatable drive assembly disposed on said frame, said drive assembly having a spur gear;

a cam disposed on said frame, said cam having a central axis and a first axis parallel and eccentric to said central axis, said cam being rotatable about said first axis;

a hand actuated lever pivotally mounted on said cam to rotate about said cam central axis, said lever having a gear rack formed at one end remote from said cam, said gear rack for engaging said spur gear;

adjusting means associated with said cam for selectively rotating said cam about said first axis, the rotating of said cam changing the relative distance between said central cam axis and said drive assembly spur gear to alter the degree of engagement between said bear rack and said spur gear; and means associated with said frame for frictionally holding said cam in a fixed position relative to said frame and said spur gear.

2. The apparatus of claim 1 wherein said adjusting means includes a socket for receiving a tool, said cam being selectively adjusted by rotation of said tool inserted in said socket.

3. The apparatus of claim 1 wherein said cam includes at least one pin extending axially from said cam, said pin being frictionally fit in an aperture in said frame.

4. The apparatus of claim 1 wherein said cam comprises a cylindrical body, the central axis of rotation extending through the center thereof, and a pin extending axially from said cam, said pin being coaxial with said first axis and being frictionally fit in an aperture in said frame.

5. The apparatus of claim 4 wherein said cam includes a socket in said pin for receiving a tool whereby insertion of said tool in said socket and rotation of said tool effects rotation of said cam relative to said frame and a change in the relative distance between said gear rack and drive means.

6. The apparatus of claim 1 wherein said lever is biased outwardly from said frame by a least one spring member mounted about the cam.

7. The apparatus of claim 1 wherein said gear rack has teeth for engaging said spur gear.

8. The apparatus of claim 7 wherein said cam, said gear rack and said spur gear are configured and situated so that rotating said cam about said first axis changes the relative distance between said central cam axis and said drive assembly spur gear by an amount less than the difference the addendum and dedendum lengths of the teeth on the gear rack such that the gear rack teeth are always engaged with said spur gear.

9. The apparatus of 7 wherein said cam, said gear rack and said spur gear are configured and situated so that rotating said cam about said first axis changes the relative distance between said central cam axis and said drive assembly spur gear by an amount greater than the difference between the addemdum and dededum lengths of the teeth on the gear rack such that the gear rack teeth can be disengaged from the spur gear.

10. A manually actuated terminal wire connecting apparatus, comprising:

a frame comprised of two complimentary opposing halves, said opposing halves being held together by removable means;

a rotatable drive assembly disposed on said frame, said drive assembly having a spur gear and a drive gear interconnected and rotatably mounted on a gear shaft, a drive shaft rotatably connected to said drive gear and adapted at one end to accommodate a terminal wire;

a cam disposed on said frame, said cam having a central axis and a first axis parallel and eccentric to said central axis, said cam being rotatable about said first axis, said cam having at least one pivot pin extending from said cam, said pivot pin being frictionally fit in an aperture in said frame;

a hand actuated lever pivotably mounted on said cam to rotate about said cam central axis, said lever having a gear rack formed at one end remote from said cam, said gear rack for engaging said spur gear;

adjusting means associated with said cam for selectively rotating said cam about said first axis, the rotating of said cam changing the relative distance between said central cam axis and said drive assembly spur gear and altering the degree of engagement between said gear rack and said spur gear;

means associated with said frame for frictionally holding said cam pivot pin in a fixed position relative to said frame and said spur gear; and a spring member mounted about said cam and contacting said frame and said hand actuated lever, said spring member biasing said lever outwardly from said frame.

11. The apparatus of claim 10 wherein the relative positions of said spur gear and said drive gear on said gear shaft may be reversed to selectively reverse the rotational direction of the drive shaft.

12. The apparatus of claim 10 further including a tensioned bar mounted in said frame such that said gear rack contacts said bar in a manner sufficient to inhibit impact between said gear rack and said frame.

* * * * *

UNITED STATES PATENT AND TRADEMARK OFFICE

CERTIFICATE OF CORRECTION

PATENT NO. : 4,620,574

DATED : November 4, 1986

INVENTOR(S) : Paul R. KILMER

It is certified that error appears in the above-identified patent and that said Letters Patent is hereby corrected as shown below:

Claim 9, line 6, change "addemdum and dededum" to

--addendum and dedendum--.

Signed and Sealed this

Third Day of March, 1987

*Attest:*

DONALD J. QUIGG

*Attesting Officer*

*Commissioner of Patents and Trademarks*